US010450801B2

(12) United States Patent
Zhang et al.

(10) Patent No.: US 10,450,801 B2
(45) Date of Patent: Oct. 22, 2019

(54) CASING WINDOWING METHOD AND TOOL USING COILED TUBING

(71) Applicants: China National Petroleum Corporation, Beijing (CN); CNPC Engineering Technology R&D Company Limited, Beijing (CN)

(72) Inventors: Yanping Zhang, Beijing (CN); Xuehui Li, Beijing (CN); Qianli Wu, Beijing (CN); Yongliang Yu, Beijing (CN); Chuan Cao, Beijing (CN); Mingjie Lv, Beijing (CN); Tao Jia, Beijing (CN); Yi Yang, Beijing (CN)

(73) Assignees: CHINA NATIONAL PETROLEUM CORPORATION, Beijing (CN); CNPC ENGINEERING TECHNOLOGY R&D COMPANY LIMITED, Beijing (CN)

( * ) Notice: Subject to any disclaimer, the term of this patent is extended or adjusted under 35 U.S.C. 154(b) by 336 days.

(21) Appl. No.: 15/363,699

(22) Filed: Nov. 29, 2016

(65) Prior Publication Data

US 2017/0152718 A1 Jun. 1, 2017

(30) Foreign Application Priority Data

Dec. 1, 2015 (CN) ..... 2015 1 0864760

(51) Int. Cl.
*E21B 7/06* (2006.01)
*E21B 23/01* (2006.01)
(Continued)

(52) U.S. Cl.
CPC ..... *E21B 7/061* (2013.01); *E21B 23/002* (2013.01); *E21B 23/01* (2013.01); *E21B 29/06* (2013.01);
(Continued)

(58) Field of Classification Search
CPC ..... E21B 37/02; E21B 23/002; E21B 23/01; E21B 7/061; E21B 29/06; E21B 33/12; E21B 33/1208
See application file for complete search history.

(56) References Cited

U.S. PATENT DOCUMENTS 5,311,936 A * 5/1994 McNair ..... E21B 7/061 166/117.6
6,318,729 B1 * 11/2001 Pitts, Jr. ..... E21B 33/10 166/332.4
(Continued)

FOREIGN PATENT DOCUMENTS

CN 101429848 A 5/2009
CN 101818619 A 9/2010
(Continued)

OTHER PUBLICATIONS

Schlumberger Oilfield Glossary entries for "drift" and "rabbit", accessed Dec. 25, 2018 via www.glossary.oilfield.s1b.com.*
(Continued)

*Primary Examiner* — Blake E Michener
(74) *Attorney, Agent, or Firm* — Hoffman Warnick LLC

(57) ABSTRACT

The present disclosure provides a casing windowing method and tool using coiled tubing; the windowing method comprises the steps of: a) preparing a borehole, including drifting a casing, and scraping an inner wall of the casing; b) hanging a positioning assembly in the casing, including seating the positioning assembly at a wellhead of the borehole, and after the positioning assembly is put down to a predetermined position in the casing, hanging a hanger of the positioning assembly at the inner wall of the casing; c) fixing a whipstock at a down-hole of the borehole, including seating the whipstock at the wellhead, and inserting a guiding assembly of the whipstock into the hanger so that an orientation of a window inclined plane of the guiding
(Continued)

assembly meets a requirement of window orientation; and d) windowing the casing, including seating a tapered windowing mill at the wellhead, and after the tapered windowing mill is put down to the window inclined plane of the guiding assembly, starting the tapered windowing mill to perform a window sidetracking of the inner wall of the casing. The casing windowing method and tool using coiled tubing of the present disclosure can accurately adjust the orientation of the inclined plane of the whipstock, and the operation is simpler, safer and more reliable.

20 Claims, 11 Drawing Sheets

(51) Int. Cl.

| | |
|---|---|
| ***E21B 33/12*** | (2006.01) |
| ***E21B 23/12*** | (2006.01) |
| ***E21B 29/06*** | (2006.01) |
| ***E21B 37/02*** | (2006.01) |
| ***E21B 17/20*** | (2006.01) |

(52) U.S. Cl.
CPC ..... *E21B 33/1208* (2013.01); *E21B 17/20* (2013.01); *E21B 37/02* (2013.01)

(56) References Cited

U.S. PATENT DOCUMENTS

2001/0040035 A1* 11/2001 Appleton ..... E21B 37/02 166/387
2002/0011340 A1* 1/2002 Murray ..... E21B 23/00 166/380
2002/0066577 A1* 6/2002 Dewey ..... E21B 7/061 166/382
2002/0074121 A1* 6/2002 Schick ..... E21B 7/061 166/313
2002/0096326 A1* 7/2002 Buytaert ..... E21B 41/0035 166/255.3
2002/0162656 A1* 11/2002 Dewey ..... E21B 23/01 166/117.5
2002/0170713 A1* 11/2002 Haugen ..... E21B 7/061 166/298
2002/0174992 A1* 11/2002 Dewey ..... E21B 23/01 166/382
2003/0037930 A1* 2/2003 Coon ..... E21B 7/061 166/380
2003/0037931 A1* 2/2003 Coon ..... E21B 23/06 166/387
2003/0183388 A1* 10/2003 Toulouse ..... E21B 4/02 166/298
2004/0177967 A1* 9/2004 Hirth ..... E21B 33/12 166/311
2004/0238171 A1* 12/2004 McGarian ..... E21B 31/00 166/301
2005/0039905 A1* 2/2005 Hart ..... E21B 10/55 166/55.7
2005/0167113 A1 8/2005 Smith et al.
2009/0166035 A1* 7/2009 Almaguer ..... E21B 7/061 166/254.1
2010/0294512 A1* 11/2010 Assal ..... E21B 7/061 166/384
2011/0253387 A1* 10/2011 Ervin ..... E21B 7/061 166/382

FOREIGN PATENT DOCUMENTS

CN 102146779 A 8/2011
CN 103375140 A 10/2013
CN 104632171 A 5/2015

OTHER PUBLICATIONS

CN Office Action 3 & English Translation thereof for CN Patent Application No. 201510864760.1, dated Sep. 10, 2018, 7 pages.

* cited by examiner

CASING WINDOWING METHOD AND TOOL USING COILED TUBING

CROSS-REFERENCE TO RELATED APPLICATIONS

This application claims the benefit of co-pending Chinese Patent Application No. 201510864760.1, filed 1 Dec. 2015, which is hereby incorporated herein as though fully set forth.

FIELD OF THE DISCLOSURE

The present disclosure relates to a casing windowing method and tool, and particularly, to a casing windowing method and tool using coiled tubing in the drilling technology field of oil and gas industry.

BACKGROUND OF THE DISCLOSURE

The coiled tubing is also referred to as coiled tubing or flexible oil tubing, which is a tubing made of low carbon alloy steel with excellent flexibility and can be winded round a roller. A roll of coiled tubing is several thousand meters long and can perform many operations instead of the conventional oil tubing. The coiled tubing operation equipment has characteristics of pressurized operation and continuous trip, the equipment volume is small, the operation cycle is short, and the cost is low.

As compared with the prior art, operating with the coiled tubing has many advantages. In particular, during a sidetracking operation, the coiled tubing could achieve a continuous circulation mud without making a connection, thereby decreasing the trip time and the operation cycle, avoiding any possible blowout or drill-jamming accident caused by making a connection, and improving the operation efficiency and security.

Although the coiled tubing drilling technique has many advantages, the aspects such as the adaptability of the coiled tubing technique to the drilling, the coiled tubing drilling process, and related tools still need to be further studied. Thus, the coiled tubing drilling technique is not practically applied in the drilling industry until 1990s. Along with the pressure attenuation of some old oilfields and the discovery of special oil-gas reservoirs, the sidetracking operation of the coiled tubing is increasingly advantageous. As to an old well, a sidetracking through the coiled tubing is an effective method to exploit the remaining reserve and reduce the cost, while the casing windowing is an indispensable key link of the sidetracking. Meanwhile, due to its distinction from the conventional drilling, the coiled tubing cannot accomplish the location and orientation of the down-hole tool at the wellhead by rotating the coiled tubing through a rotary table or a top drive device, while the window sidetracking operation is a complex down-hole operation. Therefore, how to safely and reliably complete the whole window sidetracking operation becomes the focus of the current industry.

SUMMARY OF THE DISCLOSURE

The object of the present disclosure is to provide a casing windowing method using coiled tubing, wherein a positioning assembly is put down and fixed in a casing, then an orientation of an inclined plane of a whipstock is adjusted on the ground, and the whipstock is put down into the casing and fixed on a hanger of the positioning assembly; next, a tapered windowing mill is put down to complete a windowing operation. The casing windowing method using coiled tubing of the present disclosure can accurately adjust the orientation of the inclined plane of the whipstock, and the operation is simpler, safer and more reliable.

Another object of the present disclosure is to provide a casing windowing tool using coiled tubing, comprising a positioning assembly fixed in a casing; the positioning assembly is connected to a whipstock; by adjusting orientation of an inclined plane of the whipstock, a tapered windowing mill put down later can accurately perform a windowing operation in the well according to the orientation of the inclined plane of the whipstock, and the operation is simpler, safer and more reliable.

Those objects of the present disclosure can be achieved in the following technical solutions:

The present disclosure provides a casing windowing method using coiled tubing, comprising the steps of:

a) preparing a borehole, including drifting a casing, and scraping an inner wall of the casing;

b) hanging a positioning assembly in the casing, including seating the positioning assembly at a wellhead of the borehole, and after the positioning assembly is put down to a predetermined position in the casing, hanging a hanger of the positioning assembly at the inner wall of the casing;

c) fixing a whipstock at a down-hole of the borehole, including seating the whipstock at the wellhead, and inserting a guiding assembly of the whipstock into the hanger so that an orientation of a window inclined plane of the guiding assembly meets a requirement of window orientation; and d) windowing the casing, including seating a tapered windowing mill at the wellhead, and after the tapered windowing mill is put down to the window inclined plane of the guiding assembly, starting the tapered windowing mill to perform a window sidetracking of the inner wall of the casing.

In a preferred embodiment, in the step a), the casing is drifted through a drifting tool.

In a preferred embodiment, in the step a), after the casing is drifted, the inner wall of the casing is scraped through a well wall scrape-milling tool.

In a preferred embodiment, in the step a), the inner wall of the casing is drifted and scraped through a well wall scrape-milling tool and a drifting tool connected to each other.

In a preferred embodiment, the inner wall of the casing is scraped through the well wall scrape-milling tool in a range from 10 m above a window position to 10 m below the window position in the casing.

In a preferred embodiment, in the step b), after being hanged at a predetermined position on the casing, the hanger is separated from the positioning assembly, to slowly raise a positioning assembly tool string, then put the positioning assembly tool string down to the bottom, and finally, trips out to determine whether the hanger fully expands.

In a preferred embodiment, in the step b), the positioning assembly comprises a bottom cap; an upper end of the bottom cap is connected to the hanger; an upper end of the hanger is provided with a connection rod; a lower end of the connection rod is connected to a cone inserted into the hanger; an upper end of the connection rod is orderly connected to a logging instrument, a motor head, a connector and coiled tubing to form the positioning assembly tool string; after the hanger is hanged at a predetermined position on the casing, the connection rod is separated from the hanger.

In a preferred embodiment, a middle portion of the hanger is sleeved by a plurality of convex rings and a plurality of seal sleeves interposed between every two convex rings.

In a preferred embodiment, in the step c), the hanger comprises an inclined port, the guiding assembly comprises an inclined end face fitted with the inclined port, and under a state where the inclined end face is aligned with the inclined port, and the orientation of the window inclined plane meets the requirement of window orientation.

In a preferred embodiment, in the step c), the guiding assembly comprises a locating sub inserted into the hanger, the inclined end face is formed on an upper end of the locating sub, a locating key slot communicated with the inclined port is opened on the hanger, a locating key is provided on the locating sub, a locking pin is provided at an upper end of the locating sub, a locking hole is opened in the hanger, and under a state where the locating key is inserted into the locating key slot, the locking pin is inserted into the locking hole.

In a preferred embodiment, step c1) is further comprised between the step b) and the step c): adjusting an angle of the window inclined plane on the ground, and connecting the window inclined plane with the adjusted angle to the locating sub.

In a preferred embodiment, an upper end of the locating sub is connected to an orientation guide rod having the window inclined plane, an upper end of the orientation guide rod is connected to an upper connection rod through a shear pin, and an upper end of the upper connection rod is orderly connected to a bearing sub, a motor head, a connector and coiled tubing.

In a preferred embodiment, in the step d), an upper end of the tapered windowing mill is orderly connected to a down hole motor, a motor head, a connector and coiled tubing.

The present disclosure further provides a casing windowing tool using coiled tubing, comprising:

A positioning assembly, comprising a hanger which can be hanged in a casing;

A whipstock, comprising a guiding assembly which can be inserted into the hanger of the positioning assembly, and an orientation of a window inclined plane of the guiding assembly meets a requirement of window orientation.

In a preferred embodiment, the positioning assembly comprises a bottom cap; an upper end of the bottom cap is connected to the hanger; an upper end of the hanger is provided with a connection rod; a lower end of the connection rod is connected to a cone inserted into the hanger; an upper end of the connection rod is orderly connected to a logging instrument, a motor head, a connector and coiled tubing.

In a preferred embodiment, a middle portion of the hanger is sleeved by a plurality of convex rings and a plurality of seal sleeves interposed between every two convex rings.

In a preferred embodiment, the hanger comprises an inclined port, the guiding assembly comprises an inclined end face fitted with the inclined port, and under a state where the inclined end face is aligned with the inclined port, and the orientation of the window inclined plane meets the requirement of window orientation.

In a preferred embodiment, the guiding assembly comprises a locating sub inserted into the hanger, the inclined end face is formed on an upper end of the locating sub, a locating key slot communicated with the inclined port is opened on the hanger, a locating key is provided on the locating sub, a locking pin is provided at an upper end of the locating sub, a locking hole is opened in the hanger, and under a state where the inclined end face is aligned with the inclined port, the locating key is inserted into the locating key slot and the locking pin is inserted into the locking hole.

In a preferred embodiment, an upper end of the locating sub is connected to an orientation guide rod having the window inclined plane, an upper end of the orientation guide rod is connected to an upper connection rod through a shear pin, and an upper end of the upper connection rod is orderly connected to a bearing sub, a motor head, a connector and coiled tubing.

In a preferred embodiment, the window inclined plane is fitted with a tapered windowing mill with an upper end thereof orderly connected to a down hole motor, a motor head, a connector and coiled tubing.

The casing windowing method and tool using coiled tubing of the present disclosure have the following characteristics and advantages: the present disclosure uses a split type whipstock; firstly, a hanger of a positioning assembly is put down and fixed in a casing; meanwhile, an orientation of an inclined port of the hanger is determined through a logging instrument on a positioning assembly tool string; next, an orientation of a window inclined plane of an orientation guide rod on a whipstock tool string is adjusted on the ground, and a locating sub of the whipstock tool string is locked onto the hanger in the well; next, a tapered windowing mill is put down to complete a window sidetracking operation under the guidance of the window inclined plane of the orientation guide rod. The present disclosure avoids the complex operation that puts the conventional cable type gyroscope into the coiled tubing and adjusts the window orientation in the well. The casing windowing method using coiled tubing of the present disclosure provides a safer, more reliable and accurate method for performing a windowing operation on a casing using coiled tubing.

BRIEF DESCRIPTION OF THE DRAWINGS

In order to more clearly describe the technical solutions in the embodiments of the present disclosure, accompanying drawings to be used in the descriptions of the embodiments will be briefly introduced as follows. Obviously, accompanying drawings in the following descriptions just illustrate some embodiments of the present disclosure, and a person skilled in the art can obtain other accompanying drawings from them without paying any creative effort.

DETAILED DESCRIPTION OF THE PREFERRED EMBODIMENTS

Figure 1:
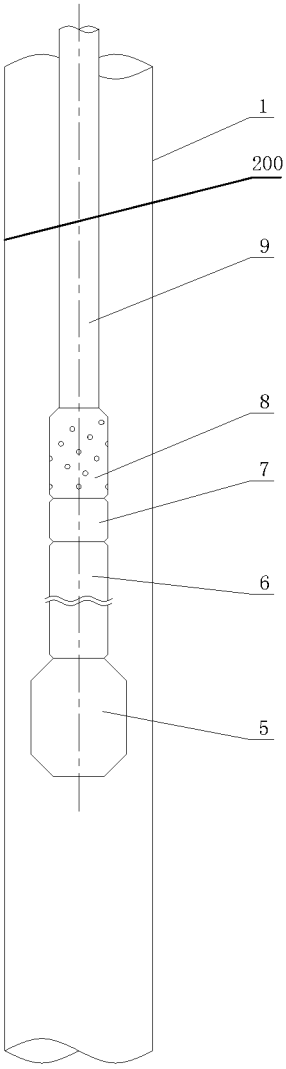
FIG. 1 is a schematic structural diagram of a drifting tool string in a casing windowing method using coiled tubing of the present disclosure.

The technical solutions in the embodiments of the present disclosure will be clearly and completely described as follows with reference to accompanying drawings of the embodiments of the present disclosure. Obviously, those described herein are just parts of the embodiments of the present disclosure rather than all the embodiments. Based on the embodiments of the present disclosure, any other embodiment obtained by a person skilled in the art without paying any creative effort shall fall within the protection scope of the present disclosure.

The present disclosure provides a casing windowing method using coiled tubing, comprising the steps of:

a) preparing a borehole, including drifting a casing 1, and scraping an inner wall of the casing 1;

b) hanging a positioning assembly 2 in the casing 1, including seating the positioning assembly 2 at a wellhead 100 of the borehole, and after the positioning assembly 2 is put down to a predetermined position in the casing 1, hanging a hanger 21 of the positioning assembly 2 at the inner wall 200 of the casing 1;

c) fixing a whipstock 3 at a down-hole of the borehole, including seating the whipstock 3 at the wellhead 100, and inserting a guiding assembly 31 of the whipstock 3 into the hanger 21; and d) windowing the casing 1, including seating a tapered windowing mill 4 at the wellhead 100, and after the tapered windowing mill 4 is put down to the guiding assembly 31, starting the tapered windowing mill 4 to perform a window sidetracking of the inner wall 200 of the casing 1.

Specifically, before step a) is executed, conventional wellhead operations, such as changing a blowout preventer, cementing a plug, cleaning a plug and testing a pressure, are performed.

After the above step is completed, as shown in FIG. 1, step a) is executed to perform a drifting operation on the casing 1 through a drifting tool 5; the drifting tool 5 is seated at the wellhead; an upper end of the drifting tool 5 is orderly connected to a heavy weight drill pipe 6, a motor head 7, a connector 8 and a coiled tubing 9; those parts are connected to each other through tube pillars of a fixed diameter, and a lower end of each tube pillar is a conventional drill pipe sub. Wherein the drifting tool 5 is used for drifting the casing 1, and its outer diameter is not less than a maximum outer diameter of a tool in the well in the subsequent step; the heavy weight drill pipe 6, the motor head 7 and the connector 8 are conventional down-hole tools for the coiled tubing drilling, and are known tools in the prior art, thus their structures are omitted herein. Through a drifting tool string composed of the drifting tool 5, the heavy weight drill pipe 6, the motor head 7, the connector 8 and the coiled tubing 9 which are orderly connected, a drifting operation can be performed on the casing 1 after the drifting tool string is put into the casing 1.

Figure 2:
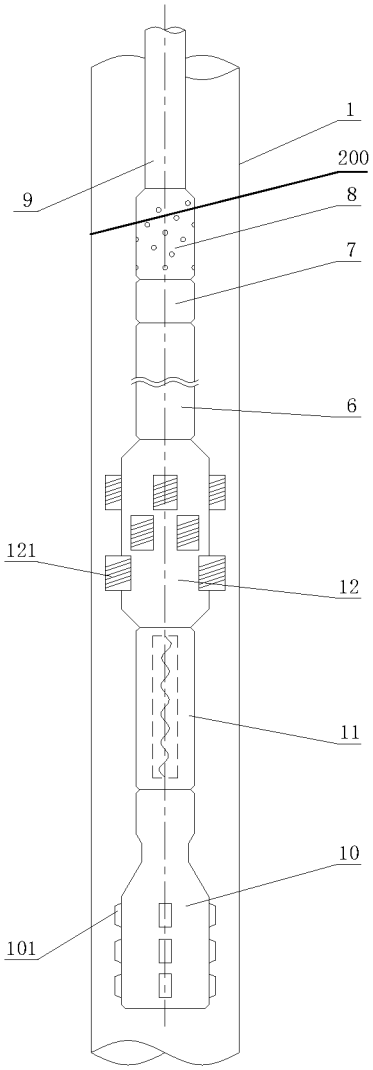
FIG. 2 is a schematic structural diagram of a scraping tool string in a casing windowing method using coiled tubing of the present disclosure.

Further, in the step a), after the drifting operation is performed on the casing 1, a scraping operation is performed on the inner wall 200 of the casing 1 through a well wall scrape-milling tool 10: firstly, the drifting tool string in the casing 1 is pulled out, and then the well wall scrape-milling tool 10 is seated at the wellhead; as shown in FIG. 2, an upper end of the well wall scrape-milling tool 10 is orderly connected to a down hole motor 11, a spring type scraper 12, the heavy weight drill pipe 6, the motor head 7, the connector 8 and the coiled tubing 9. Wherein, a lower end of the well wall scrape-milling tool 10 is a tapered bottom cap, and a middle portion thereof having several blades 101 circumferentially fixed through bolts; an interior lower end of the well wall scrape-milling tool 10 and an upper end of the bottom cap are mounted with a spring having its upper end press-placed with a hollow connection rod; when the blade 101 does not work, it can be embedded into the well wall scrape-milling tool 10 to be fitted with an inclined plane at an outer diameter of the hollow connection rod; and when the blade 101 works, a pressurization is made on the ground, and a pressure difference is generated to compress the spring when a hydraulic pressure passes by a reduced part of the hollow connection rod, so that the hollow connection rod moves downward and drives the blade 101 to be stretched by means of the inclined plane, thus the blade 101 contacts the well wall, and the purpose of scrape-milling the well wall is achieved by rotating the well wall scrape-milling tool 10. Through a scraping tool string composed of the well wall scrape-milling tool 10, the down hole motor 11, the spring type scraper 12, the heavy weight drill pipe 6, the motor head 7, the connector 8 and the coiled tubing 9 which are orderly connected, a scraping operation can be performed on the inner wall 200 of the casing 1 and the inner wall of a segment of the casing 1 hanged by the positioning assembly 2 in the subsequent step, after the scraping tool string is put into the casing 1. Wherein, the well wall scrape-milling tool 10, the down hole motor 11 and the spring type scraper 12 are conventional down-hole tools for the coiled tubing drilling, and are known tools in the prior art, thus their structures are omitted herein.

The well wall scrape-milling tool 10 is driven to work by the down hole motor 11. During working, the pump pressure stretches the blades 101 on the circumference of the well wall scrape-milling tool 10, and retains the outer diameter of the blades 101, so as to accurately scrape-mill the inner wall 200 of the casing 1. The down hole motor 11 is a tool for down-hole rotation and torque provision used in the down-hole operations of the petroleum industry. In the present disclosure, the down hole motor 11 is driven to rotate by a hydraulic pressure, so as to drive the well wall scrape-milling tool 10 connected to its lower end to rotate and work. The spring type scraper 12 is a down-hole tool that causes, through its spring, scraping blocks 121 on the circumference of the tool to generate a continuous press on the inner wall 200 of the casing 1. When the spring type scraper 12 works down-hole, the scraping block 121 retains a press on the inner wall 200 of the casing 1 under the effect of the spring, so as to clean the inner wall 200 of the casing 1.

Figure 3:
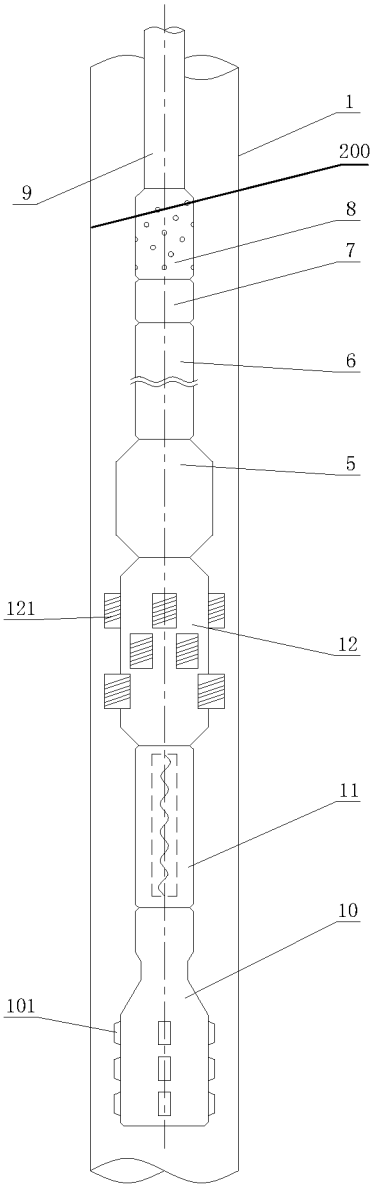
FIG. 3 is a schematic structural diagram of a drifting and scraping tool string in a casing windowing method using coiled tubing of the present disclosure.

According to another embodiment of the present disclosure, as shown in FIG. 3, in step a), a drifting operation and a scraping operation can be performed simultaneously on the inner wall 200 of the casing 1 by the well wall scrape-milling tool 10 and the drifting tool 5 connected to each other. In this embodiment, the upper end of the well wall scrape-milling tool 10 is orderly connected to the down hole motor 11, the spring type scraper 12, the drifting tool 5, the heavy weight drill pipe 6, the motor head 7, the connector 8 and the coiled tubing 9. Through a drifting and scraping tool string composed of the well wall scrape-milling tool 10, the down hole motor 11, the spring type scraper 12, the drifting tool 5, the heavy weight drill pipe 6, the motor head 7, the connector 8 and the coiled tubing 9 which are orderly connected, a drifting operation and a scraping operation can be performed on the casing 1 after the drifting and scraping tool string is put into the casing 1.

During the operation, the whole drifting and scraping tool string or scraping tool string is put into the casing 1 about 10 m above a window position in the casing 1, and the pump is started for circulation. In that case, the well wall scrape-milling tool 10 is driven to rotate by the down hole motor 11; after the blade 101 is stretched to a designed outer diameter, the whole drifting and scraping tool string or scraping tool string is slowly put down to be about 10 m below the window position in the casing 1, so that the blade 101 of the well wall scrape-milling tool 10 is in continuous rotary contact with the specified inner wall of the casing 1, thereby accurately scrape-milling the inner wall of a segment of the casing 1 hanged by the positioning assembly 2 in the subsequent step. In the present disclosure, the number of times of scraping the inner wall 200 of the casing 1 in a range from 10 m above the window position to 10 m below the window position of the casing 1 through the well wall scrape-milling tool 10 is determined by the well conditions, and is not limited herein.

Figure 4:
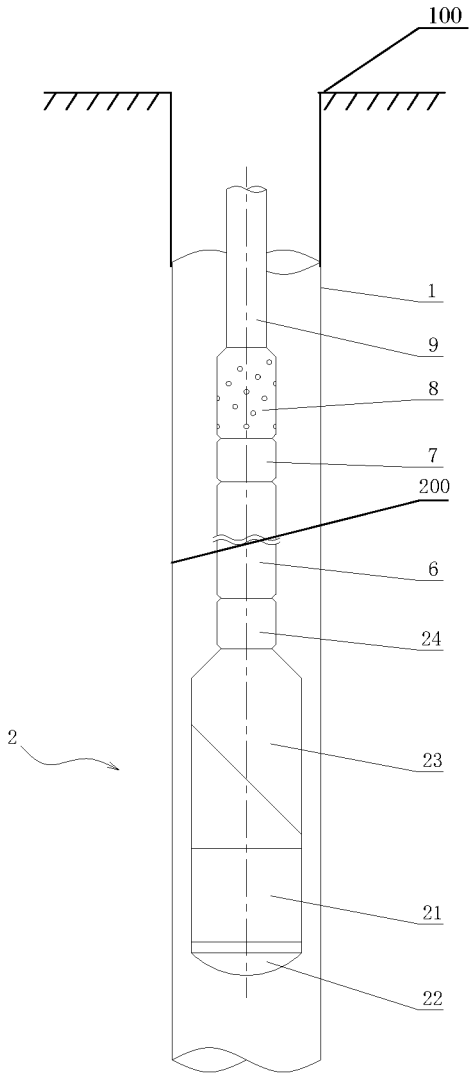
FIG. 4 is a schematic structural diagram of a positioning assembly tool string in a casing windowing method using coiled tubing of the present disclosure.
Figure 5:
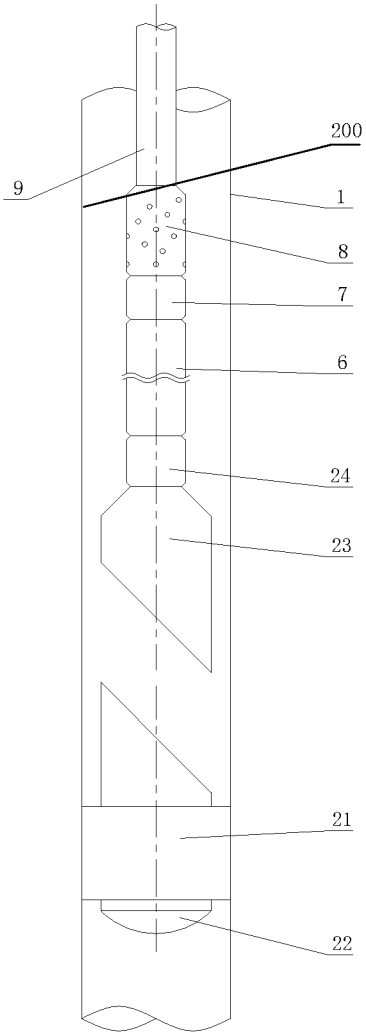
FIG. 5 is a schematic structural diagram in which a hanger of a positioning assembly tool string is anchored in a casing during a casing windowing method using coiled tubing of the present disclosure.

In step b), as shown in FIGS. 4 and 5, after step a) is completed, the drifting and scraping tool string or scraping tool string is pulled out from the casing 1, and the positioning assembly 2 is seated at the wellhead; after the positioning assembly 2 is put to a predetermined position in the casing 1, the hanger 21 of the positioning assembly 2 is hanged at the inner wall 200 of the casing 1. The purpose of the hanger 21 of the positioning assembly 2 is to fix the required tube pillars on the inner wall 200 of the casing 1, and the fixing manner is not limited to the particular manners described herein, and a hydraulic bulge or a mechanical manner can also achieve the purpose.

Specifically, the positioning assembly 2 comprises a bottom cap 22; an upper end of the bottom cap 22 is connected to the hanger 21; an upper end of the hanger 21 is provided with a connection rod 23; a lower end of the connection rod 23 is connected to a cone inserted into the hanger 21; an upper end of the connection rod 23 is orderly connected to a logging instrument 24, the heavy weight drill pipe 6, the motor head 7, the connector 8 and the coiled tubing 9.

Figure 6:
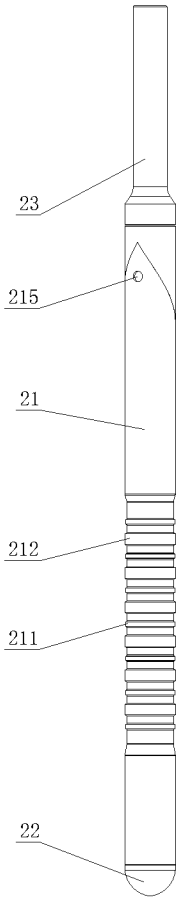
FIG. 6 is a schematic structural diagram of a positioning assembly of a positioning assembly tool string in a casing windowing method using coiled tubing of the present disclosure.
Figure 7:
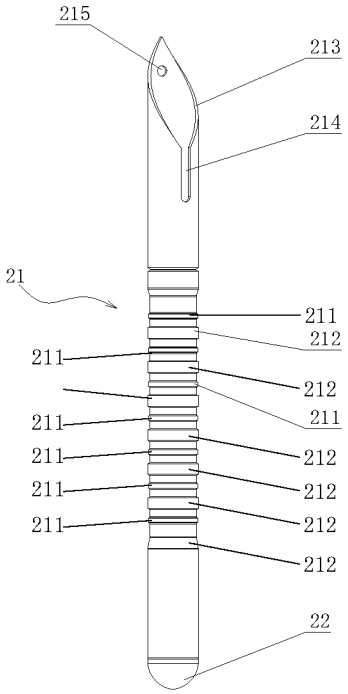
FIG. 7 is a schematic structural diagram of a hanger of a positioning assembly in a casing windowing method using coiled tubing of the present disclosure.

The bottom cap 22 is used to form the sealed chamber at a lower end of the hanger 21, so as to provide a pressure cavity for the subsequent expanding operation. In this embodiment, as shown in FIGS. 6 and 7, a middle portion of the hanger 21 is sleeved by a plurality of convex rings 211 and a plurality of seal sleeves 212 interposed between every two convex rings 211, wherein the plurality of convex rings 211 are distributed in an equal interval.

During operation, through a positioning assembly tool string composed of the positioning assembly 2, the logging instrument 24, the heavy weight drill pipe 6, the motor head 7, the connector 8 and the coiled tubing 9 which are orderly connected, the positioning assembly tool string is put to a predetermined position in the casing 1, and then it is checked whether the predetermined position meets a designed depth. In the present disclosure, the predetermined position in the casing 1 is considered comprehensively based on a window position required by the well design and the tool length of the whipstock 3, in conjunction with the depth measurement error, so that the actual window position of the casing meets the window position requirement in the well design. When the positioning assembly tool string is put down in place, high pressure liquid is injected into the coiled tubing 9 to start a pressurizing operation. When the pressure reaches a predetermined pressure value, the connection rod 23 of the positioning assembly 2 drives the cone connected at its lower end to move into the hanger 21 under the effect of the high pressure liquid, so that the hanger 21 expands radially outward; the plurality of seal sleeves 212 of the hanger 21 are attached to the inner wall 200 of the casing 1, so as to be fixed at predetermined positions on the inner wall 200 of the casing 1. In that case, the injection of the high pressure liquid into the coiled tubing 9 is continued, and when a ground pump pressure is suddenly indicated as zero, the connection rod 23 of the positioning assembly 2 is separated from the hanger 21 to slowly raise the positioning assembly tool string, and then again put the positioning assembly tool string down to the bottom, and finally, trips out to determine whether the hanger 21 expands enough.

In the present disclosure, an opening at an upper end of the hanger 21 of the positioning assembly 2 is an inclined port 213, which is a horseshoe inclined plane; a lower end of the connection rod 23 is in a butt connection with the inclined port 213 of the hanger 21; the hanger 21 is provided with a locating key slot 214 communicated with the inclined port 213 and located at an inclined lower end of the inclined port 213. Further, the hanger 21 is provided with a locking hole 215, which is provided closely to the inclined port 213 at an inclined upper end of the inclined port 213 and provided radially opposite to the locating key slot 214. The hanger 21 is used to fix the guiding assembly 31 of the whipstock 3 in the casing 1 in the subsequent step, so that the whipstock 3 cannot move up and down or rotate in the well.

The logging instrument 24 provided on the positioning assembly tool string is used to measure and record orientation of the inclined port 213 of the hanger 21 of the positioning assembly 2, having a built-in medium for storing data, and it automatically measures and records orientation data during working.

In step c), after step b) is finished, i.e., after the hanger 21 of the positioning assembly 2 is fixed on the inner wall 200 of the casing 1, the connection rod 23 of the positioning assembly 2 is separated from the hanger 21 under the effect of the high pressure liquid. In that case, the positioning assembly tool string is pulled out, then the whipstock 3 is seated at the wellhead, and the guiding assembly 31 of the whipstock 3 is inserted into the hanger 21.

Figure 8:
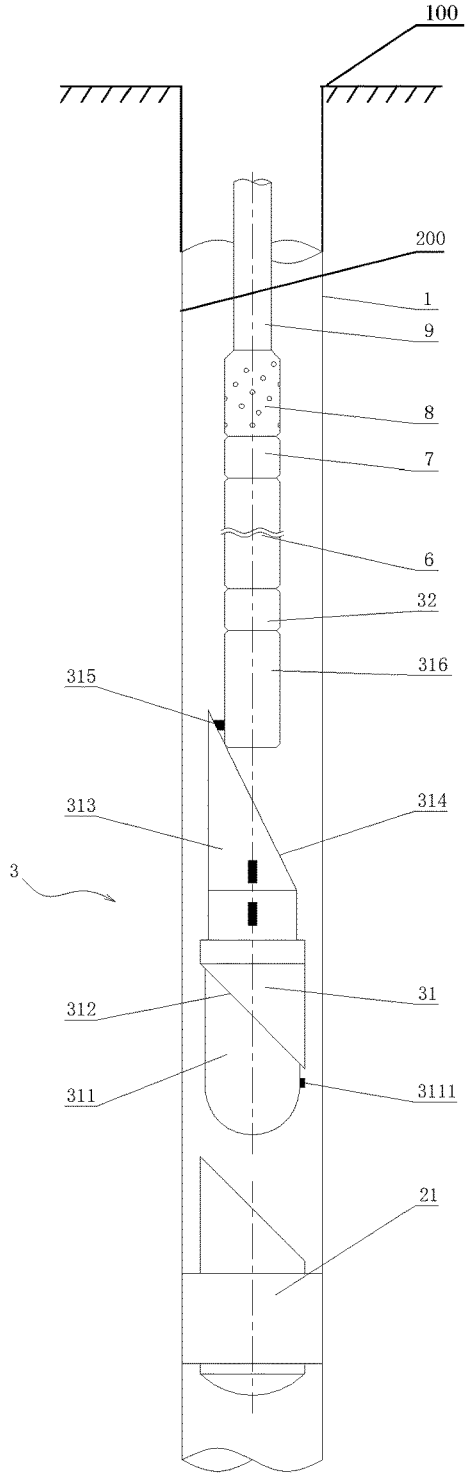
FIG. 8 is a schematic structural diagram of a whipstock tool string in a casing windowing method using coiled tubing of the present disclosure.

Specifically, as shown in FIG. 8, the guiding assembly 31 of the whipstock 3 comprises a locating sub 311 and an orientation guide rod 313 inserted into the hanger 21, wherein an inclined end face 312 fitted with the inclined port 213 of the hanger 21 is formed at an upper end of the locating sub 311; the orientation guide rod 313 is connected to the upper end of the locating sub 311, and it comprises a window inclined plane 314 for guiding the window side-tracking operation, so as to guide and limit the working direction of the tapered windowing mill when a window is opened in the casing; the upper end of the orientation guide rod 313 is connected to an upper connection rod 316 through a shear pin 315, and an upper end of the upper connection rod 316 is orderly connected to a bearing sub 32, the heavy weight drill pipe 6, the motor head 7, the connector 8 and the coiled tubing 9.

Through a whipstock tool string composed of the guiding assembly 31, the upper connection rod 316, the heavy weight drill pipe 6, the motor head 7, the connector 8 and the coiled tubing 9 which are orderly connected, the present disclosure can achieve the purpose of putting the guiding assembly 31 into the casing 1 and lock it on the hanger 21.

In this embodiment, the locating sub 311 is provided with a locating key 3111, and the upper end of the locating sub 311 is provided with a locking pin (not illustrated). After the whipstock tool string is put into the casing 1, the locating short stud 311 of the guiding assembly 31 is inserted into the hanger 21, and the inclined end face 312 at the upper end of the locating sub 311 is fitted with the inclined port 213 of the hanger 21, so that the locating key 3111 of the locating sub 311 is inserted into the locating key slot 214 of the hanger 21, and the locking pin of the locating sub 311 is inserted into the locking hole 215 of the hanger 21. In that case, the guiding assembly 31 will be locked in the hanger 21.

The locating key 3111 and the locking pin of the locating sub 311 can ensure that in the well, the guiding assembly 31 is directed in a specified orientation and locked with the hanger 21 of the positioning assembly 2.

Figure 9:
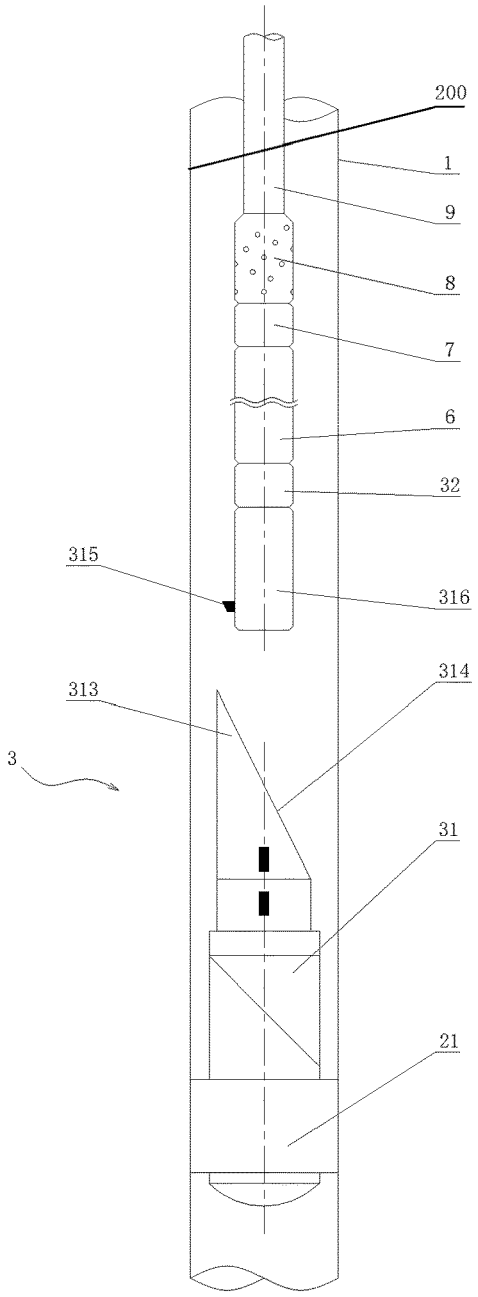
FIG. 9 is a schematic structural diagram in which a shear pin of a whipstock tool string is sheared in a casing windowing method using coiled tubing of the present disclosure.

During the working of the whipstock tool string, firstly, a direction of the window inclined plane 314 of the guiding assembly 31 of the whipstock 3 is calculated based on data recorded by the logging instrument 24 of the positioning assembly tool string, and an angle of the window inclined plane 314 is manually adjusted on the ground so that the orientation of the window inclined plane 314 after the guiding assembly 31 is locked with the hanger 21 of the positioning assembly 2 in the well meets the requirement of window orientation; after the angle of the window inclined plane 314 is adjusted, the orientation guide rod 313 is fixed on the locating sub 311 by welding; next, after the whipstock tool string is put to be about 10 m above the hanger 21 of the positioning assembly 2, a hanging load for raising and putting down the whipstock tool string is measured and recorded, so as to prevent the hanger 21 from being broken when it hangs the inner wall 200 of the casing 1; next, the whipstock tool string is further put down, and when a proper position is reached, the locating sub 311 on the guiding assembly 31 of the whipstock tool string is fitted with the hanger 21 of the positioning assembly 2 under the self-weight for an automatic locking. In that case, certain tons are raised according to a predetermined excessive raising amount to cut off the shear pin 315 between the orientation guide rod 313 and the upper connection rod 316, as shown in FIG. 9. In that case, the guiding assembly 31 is separated from the tube pillar at the upper portion of the whipstock tool string, and then the drilling tool set is pulled out.

Figure 10:
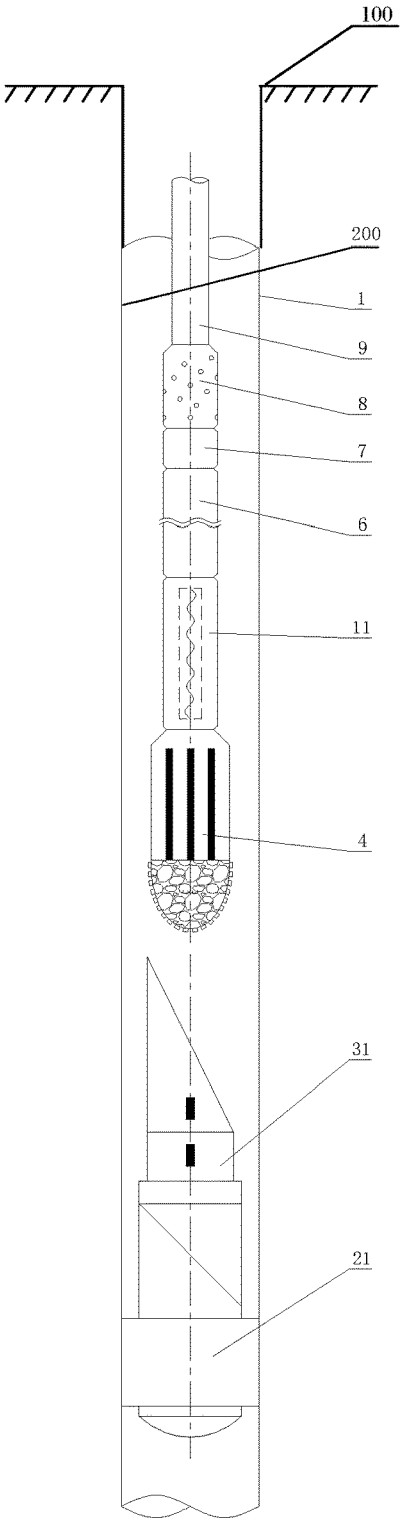
FIG. 10 is a schematic structural diagram of a tapered windowing mill tool string in a casing windowing method using coiled tubing of the present disclosure.
Figure 11:
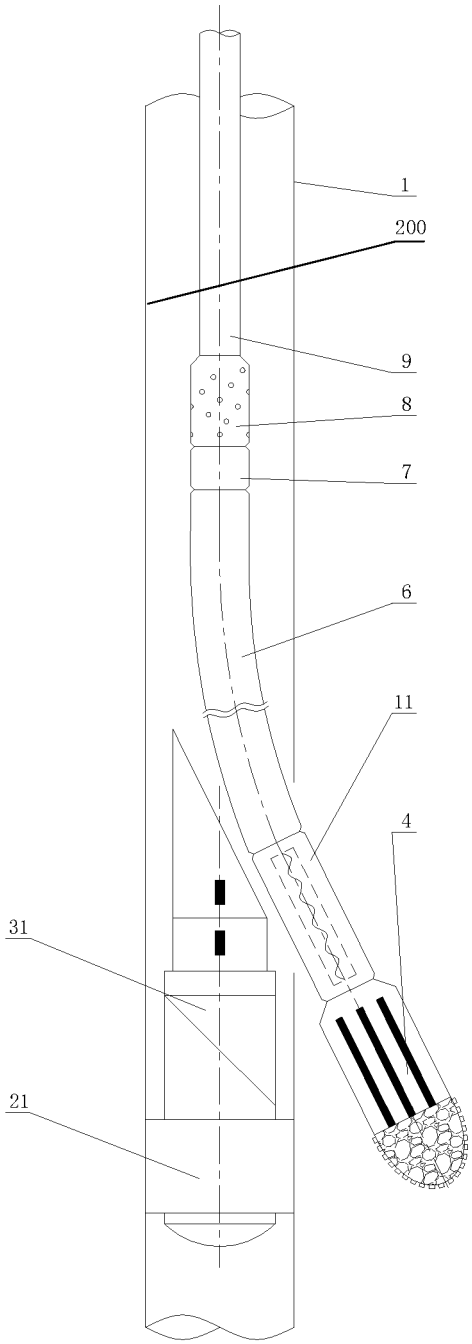
FIG. 11 is a schematic structural diagram of a window sidetracking of a tapered windowing mill tool string in a casing windowing method using coiled tubing of the present disclosure.

In step d), after step c) is finished, as shown in FIGS. 10 and 11, the tapered windowing mill 4 is seated at the wellhead; after being put down to the guiding assembly 31, the tapered windowing mill 4 is started to perform a window sidetracking of the inner wall 200 of the casing 1.

Specifically, the upper end of the tapered windowing mill 4 is orderly connected to the down hole motor 11, the heavy weight drill pipe 6, the motor head 7, the connector 8 and the coiled tubing 9. Through a tapered windowing mill tool string composed of the tapered windowing mill 4, the down hole motor 11, the heavy weight drill pipe 6, the motor head 7, the connector 8 and the coiled tubing 9 which are orderly connected, an window sidetracking operation may be performed on the inner wall of the casing. In the present disclosure, the particle size of alloy particles of the tapered windowing mill 4 is one level lower than that of windowing by sidetracking the casing with the conventional drill pipe.

During working, after the tapered windowing mill tool string is put down to be about 2 m above the guiding assembly 31, a hanging load for raising and putting down is measured and recorded; the pump is started for one cycle; the pump displacement is determined based on the factors such as a rotation speed and a pressure drop of the down hole motor 11, and a pressure drop of the tapered windowing mill 4; the pump pressure and hanging load in the idle time are recorded, and the whole tapered windowing mill tool string is slowly put down; when a bit pressure occurs, the drill string begins to be rotated; the depth position of the tapered windowing mill 4 at the beginning of milling is recorded; the bit pressure is determined based on the factors such as the output torque of the down hole motor 11, the pump pressure and the milling efficiency of the tapered windowing mill; the displacement and the bit pressure are retained when the wellhead returns drilling cuttings containing cement sheaths or stratums, and the drilling tool set is further put down for drilling; when the actual milling footage exceeds the theoretically calculated footage, a guide hole of 3-5 m is further drilled with the drilling tool set according to the requirement of conventional directional sidetracking; after a sufficient cycle in the well, the whole tapered windowing mill tool string is pulled out.

The casing windowing method using coiled tubing of the present disclosure uses a split type whipstock 3; firstly, the hanger 21 of the positioning assembly 2 is put down and fixed in the casing 1; meanwhile, the orientation of the inclined port 213 of the hanger 21 is determined through the logging instrument 24 of the positioning assembly tool string; next, the orientation of the window inclined plane 314 of the orientation guide rod 313 of the whipstock tool string is adjusted on the ground, and the locating sub 311 of the whipstock tool string is locked onto the hanger 21 in the well; next, the tapered windowing mill 4 is put down to complete the window sidetracking operation under the guidance of the window inclined plane 314 of the orientation guide rod 313. The present disclosure avoids the complex operation that puts the conventional cable type gyroscope into the coiled tubing and adjusts the window orientation in the well. The casing windowing method using coiled tubing of the present disclosure provides a safer and more reliable method for performing a windowing operation on a casing using coiled tubing.

In a specific embodiment of the present disclosure, a casing windowing operation for a second section vertical well sidetracking is taken as an example to describe the specific progress of implementation of the present disclosure. The production casing 1 of the well has an outer diameter of 39.7 mm and a wall thickness of 7.72 mm; a measured depth of the windowing point is 1550 m; a bit size used for the naked eyes in sidetracking is 120.6 mm; an outer diameter of the coiled tubing 9 is 73 mm; a total length after the positioning assembly 2 is locked with the guiding assembly 31 with the outer force released is 4.7 m; an inclination angle of the window inclined plane 314 of the orientation guide rod 313 of the whipstock 3 is 2.5°; and an outer diameter of the tapered windowing mill 4 is 121 mm. In the construction progress, the specific construction steps of the present disclosure are as follows:

Firstly, performing an operation of drifting the casing 1, scraping the inner wall 200 of the casing 1, and scrape-milling the inner wall of a segment of the casing 1 hanged by the positioning assembly 2, as shown in FIG. 3. The drifting and scraping tool string composed of the well wall scrape-milling tool 10, the down hole motor 11, the spring type scraper 12, the drifting tool 5, the heavy weight drill pipe 6, the motor head 7, the connector 8 and the coiled tubing 9 which are orderly threaded-connected. Wherein, the outer diameter of the drifting tool 5 is 121 mm, the outer diameter of the scraping block 121 of the spring type scraper 12 is 129 mm, and the outer diameter of the stretched blade 101 when the well wall scrape-milling tool 10 works is 124 mm.

Before the casing 1 is windowed, the well repairing team performs necessary processing of the wellhead and the shaft, such as flushing the well, changing a blowout preventer, drifting the well, cementing a plug, testing a pressure and cleaning a plug.

Based on the above shaft processing operation, the drifting and scraping tool string is connected orderly; when the drilling depth is 1540 m, the pump is started for circulation, and the hanging load for raising and putting down is measured. In that case, the blade 101 of the well wall scrape-milling tool 10 is stretched and begins to be rotated; the drilling tool is slowly put down until the drilling depth reaches 1560 m to finish one time of scrape-milling of the inner wall of a segment of the casing hanged by the positioning assembly; the well segment from 1540 m to 1560 m is again scrape-milled, and the drilling tool set is pulled out after one cycle.

Sometimes based on the actual well conditions and the demand of the drilling site, the above step of drifting the casing, scraping the inner wall of the casing, and scrape-milling the inner wall of a segment of the casing hanged by the positioning assembly may be performed by two times of drilling. That is, firstly the drifting tool string composed of the drifting tool 5, the heavy weight drill pipe 6, the motor head 7, the connector 8 and the coiled tubing 9 which are orderly connected is put down for drifting the casing 1, as shown in FIG. 1; next, the scraping tool string composed of the well wall scrape-milling tool 10, the down hole motor 11, the spring type scraper 12, the heavy weight drill pipe 6, the motor head 7, the connector 8 and the coiled tubing 9 which are orderly connected is put down for scraping the inner wall of the casing, and scrape-milling the inner wall of a segment of the casing hanged by the positioning assembly, as shown in FIG. 2.

After the operation of drifting the casing 1, scraping the inner wall of the casing 1, and scrape-milling the inner wall of a segment of the casing 1 hanged by the positioning assembly is completed, the positioning assembly 2 is put down and hanged, as shown in FIGS. 4 and 5. Through the positioning assembly tool string composed of the positioning assembly 2, the logging instrument 24, the heavy weight drill pipe 6, the motor head 7, the connector 8 and the coiled tubing which are orderly threaded-connected, an operation of hanging the hanger 21 of the positioning assembly 2 on the inner wall 200 of the casing 1 is performed. Wherein, the positioning assembly 2 is used to fix the guiding assembly 31 of the whipstock 3 in the well, so that the whipstock 3 cannot move up and down or rotate in the well. The hanger 21 of the positioning assembly 2 is designed with an inclined port 213, which can orientate and lock the guiding assembly 31 of the whipstock 3 in a specified direction by means of mechanical coupling.

A drilling depth of 1554.7 m is reached by the positioning assembly tool string; after an interface of a cement truck matched with the coiled tubing 9 is connected, high pressure liquid is injected into the coiled tubing 9 for a pressurizing operation; when the pressure reaches 24 MPa, the hanger 21 of the positioning assembly 2 is tightly attached to the inner wall 200 of the casing 1, so that the hanger 21 of the positioning assembly 2 is hanged at 1554.7 m; the pressurizing operation is completed when the pump pressure suddenly drops to zero; the drilling tool is slowly raised, and the positioning assembly 2 automatically releases; the drilling tool is again put to the bottom and then pulled out.

On the ground, the orientation of the window inclined plane 314 of the orientation guide rod 313 of the whipstock 3 is adjusted according to the data obtained by the logging instrument 24, and the guiding assembly 31 is put down and locked, as shown in FIGS. 8 and 9. Through the whipstock tool string composed of the guiding assembly 31, the upper connection rod 316, the heavy weight drill pipe 6, the motor head 7, the connector 8 and the coiled tubing 9 which are connected orderly, the purpose of locking the guiding assembly 31 on the hanger 21 is achieved. Wherein, the guiding assembly 31 is used to control the working direction of the tapered windowing mill 4 when the casing is windowed; the locating key 3111 and the locking pin of the guiding assembly 31 can ensure that in the well, the guiding assembly 31 is directed in a specified orientation and locked with the hanger 21 of the positioning assembly 2.

The orientation of the orientation guide rod 313 of the guiding assembly 31 is calculated based on data recorded by the logging instrument 24 of the positioning assembly tool string; the angle of the window inclined plane 314 of the orientation guide rod 313 of the whipstock 3 is manually adjusted on the ground, so that after the guiding assembly 31 is put down and locked with the hanger 21 of the positioning assembly 2 in the well, the orientation of the window inclined plane 314 of the orientation guide rod 313 meets the requirement of window orientation; after the angle of the window inclined plane 314 of the orientation guide rod 313 is adjusted, the orientation guide rod 313 is fixed by manual arc welding; the whipstock tool string is put to a depth of 1544 m; the hanging load for raising and putting down is measured and recorded; the drilling tool is further put down, and when a proper position is reached, the guiding assembly 31 is locked with the hanger 21 of the positioning assembly 2. Next, 4 tons are excessively raised to cut off the shear pin 315 of the whipstock tool string, and the guiding assembly 31 releases, so as to pull the whole whipstock tool string from the well bottom.

Finally, a window milling operation is performed, as shown in FIGS. 10 and 11. The tapered windowing mill tool string comprises the tapered windowing mill 4, the down hole motor 11, the heavy weight drill pipe 6, the motor head 7, the connector 8 and the coiled tubing 9 connected orderly. Wherein, the down hole motor 11 may be a low-speed large-torque type, and the alloy particles of the tapered windowing mill 4 may have a size of 4 mm. The drilling is made until 1548 m with the drilling tool set; the hanging load for raising and putting down is measured and recorded; the pump is started for one cycle; the pump displacement is 8 L/s to 10 L/s; the drilling tool set is slowly put down to the bottom; when a bit pressure occurs, a milling of the casing 1 begins; a depth position of the tapered windowing mill 4 at the beginning of milling is recorded; the bit pressure is 0.5 t to 1 t; a change of the pump pressure or the milling footprint is closely observed; when the wellhead returns drilling cuttings containing cement sheaths or stratums, it means that the casing 1 is windowed, then the displacement and the bit pressure are retained, and a further drilling is made; when the actual milling footage exceeds 2.77 m (121 mm/sin 2.5°≈2.77 m), it means that the window milling is finished, then a guide hole of 3-5 m is drilled; after a sufficient cycle, the whole drilling tool set is pulled out.

The above descriptions are just several embodiments of the present disclosure. A person skilled in the art can make various changes or modifications to the embodiments of the present disclosure according to the disclosure of the application document, without deviating from the sprint and scope of the present disclosure.

The invention claimed is:

1. A casing windowing method using coiled tubing, comprising the steps of:

a) preparing a borehole, including drifting a casing, and scraping an inner wall of the casing;

b) hanging a positioning assembly in the casing, including seating the positioning assembly at a wellhead of the borehole, connecting the coiled tubing to the positioning assembly and then putting the positioning assembly down into the casing using the coiled tubing, and after the positioning assembly is put down to a predetermined position in the casing, hanging a hanger of the positioning assembly with an inclined port at the inner wall of the casing, measuring and recording an orientation of the inclined port of the hanger using a logging instrument connected to the positioning assembly;

c) fixing a whipstock within the borehole, including seating the whipstock at the wellhead, adjusting the direction of a window inclined plane of a guiding assembly of the whipstock on the ground relative to the coiled tubing in response to the recorded orientation of the inclined port of the hanger, connecting the coiled tubing to the whipstock and then putting the whipstock down into the casing using the coiled tubing, and inserting the guiding assembly of the whipstock with an inclined end face that can be fitted with the inclined port into the hanger until the inclined end face of the guiding assembly is aligned with the inclined port of the hanger so that an orientation of the window inclined plane of the guiding assembly meets a requirement of window orientation; and d) windowing the casing, including seating a tapered windowing mill at the wellhead, connecting the coiled tubing to the tapered windowing mill and then putting the tapered windowing mill down into the casing using the coiled tubing, and after the tapered windowing mill put down to the window inclined plane of the guiding assembly, starting the tapered windowing mill to perform a window sidetracking of the inner wall of the casing.

2. The casing windowing method using coiled tubing according to claim 1, wherein in the step a), the casing is drifted by a drifting tool.

3. The casing windowing method using coiled tubing according to claim 2, wherein in the step a), after the casing is drifted, the inner wall of the casing is scraped by a well wall scrape-milling tool.

4. The casing windowing method using coiled tubing according to claim 1, wherein in the step a), the inner wall of the casing is drifted and scraped by a well wall scrape-milling tool and a drifting tool connected to each other.

5. The casing windowing method using coiled tubing according to claim 3, wherein the inner wall of the casing is scraped by the well wall scrape-milling tool in a range from 10 m above a window position to 10 m below the window position in the casing.

6. The casing windowing method using coiled tubing according to claim 4, wherein the inner wall of the casing is scraped by the well wall scrape-milling tool in a range from 10 m above a window position to 10 m below the window position in the casing.

7. The casing windowing method using coiled tubing according to claim 1, wherein in the step b), the positioning assembly comprises a bottom cap; an upper end of the bottom cap is connected to the hanger; an upper end of the hanger is provided with a connection rod; an upper end of the connection rod, the logging instrument, a motor head, a connector and the coiled tubing are connected in sequence to form a positioning assembly tool string, after being hanged at a predetermined position on the casing, the hanger is separated from the positioning assembly, to raise the positioning assembly tool string, then put the positioning assembly tool string down to a bottom of the hanger, and finally, trips out to determine whether the hanger expands enough to be fixed at the predetermined position on the inner wall of the casing.

8. The casing windowing method using coiled tubing according to claim 7, wherein in the step b), after the hanger is hanged at the predetermined position on the casing, the connection rod is separated from the hanger.

9. The casing windowing method using coiled tubing according to claim 8, wherein a middle portion of the hanger is sleeved by a plurality of convex rings and a plurality of seal sleeves interposed between every two convex rings.

10. The casing windowing method using coiled tubing according to claim 1, wherein in the step c), the guiding assembly comprises a locating sub inserted into the hanger, the inclined end face is formed on an upper end of the locating sub, a locating key slot communicated with the inclined port is provided on the hanger, a locating key that can be inserted into the locating key slot is provided on the locating sub, a locking hole is provided on the hanger.

11. The casing windowing method using coiled tubing according to claim 10, further comprising step c1) between the step b) and the step c), step c1) comprising: connecting the window inclined plane with the adjusted direction to the locating sub.

12. The casing windowing method using coiled tubing according to claim 11, wherein the guiding assembly of the whipstock comprises an orientation guide rod and an upper end of the locating sub is connected to the orientation guide rod having the window inclined plane, an upper end of the orientation guide rod is connected to an upper connection rod through a shear pin, and an upper end of the upper connection rod, a bearing sub, a motor head, a connector and the coiled tubing are connected in sequence.

13. The casing windowing method using coiled tubing according to claim 1, wherein in the step d), an upper end of the tapered windowing mill, a down hole motor, a motor head, a connector and the coiled tubing are connected in sequence.

14. A casing windowing tool using coiled tubing, comprising:

a coiled tubing;

a positioning assembly that can be connected to the coiled tubing, comprising a hanger with an inclined port which can be hanged in a casing;

a logging instrument connected to the positioning assembly and configured to measure and record an orientation of the inclined port of the hanger upon the hanger being hung in the casing; and a whipstock that can be connected to the coiled tubing, and configured to be aligned relative to the coiled tubing at the surface in response to the recorded orientation of the inclined port of the hanger, comprising a guiding assembly with an inclined end fact that can be fitted with the inclined port which can be inserted into the hanger of the positioning assembly, and an orientation of a window inclined plane of the guiding assembly meets a requirement of window orientation.

15. The casing windowing tool using coiled tubing according to claim 14, wherein the positioning assembly comprises a bottom cap; an upper end of the bottom cap is connected to the hanger; an upper end of the hanger is provided with a connection rod; an upper end of the connection rod, a logging instrument, a motor head, a connector and the coiled tubing are connected in sequence.

16. The casing windowing tool using coiled tubing according to claim 15, wherein a middle portion of the hanger is sleeved by a plurality of convex rings and a plurality of seal sleeves interposed between every two convex rings.

17. The casing windowing tool using coiled tubing according to claim 14, wherein under a state where the inclined end face is aligned with the inclined port, the orientation of the window inclined plane meets the requirement of window orientation.

18. The casing windowing tool using coiled tubing according to claim 17, wherein the guiding assembly comprises a locating sub inserted into the hanger, the inclined end face is formed on an upper end of the locating sub, a locating key slot communicated with the inclined port is provided on the hanger, a locating key that can be inserted into the locating key slot is provided on the locating sub, a locking hole is provided on the hanger.

19. The casing windowing tool using coiled tubing according to claim 18, wherein the guiding assembly of the whipstock comprises an orientation guide rod and an upper end of the locating sub is connected to the orientation guide rod having the window inclined plane, an upper end of the orientation guide rod is connected to an upper connection rod through a shear pin, and an upper end of the upper connection rod, a bearing sub, a motor head, a connector and the coiled tubing are connected in sequence.

20. The casing windowing tool using coiled tubing according to claim 14, wherein the window inclined plane is fitted with a tapered windowing mill with an upper end thereof, and the upper end of the tapered windowing mill, a down hole motor, a motor head, a connector and the coiled tubing are connected in sequence.

* * * * *